US011371450B2

(12) United States Patent
Pieczko et al.

(10) Patent No.: US 11,371,450 B2
(45) Date of Patent: Jun. 28, 2022

(54) NVH MANAGEMENT IN DIESEL CDA MODES

(71) Applicant: Eaton Intelligent Power Limited, Dublin (IE)

(72) Inventors: Matthew Pieczko, Mattawan, MI (US); James E. McCarthy, Jr., Kalamazoo, MI (US); Akibi Archer, Kalamazoo, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/435,458

(22) Filed: Jun. 7, 2019

(65) Prior Publication Data

US 2019/0376459 A1 Dec. 12, 2019

Related U.S. Application Data

(60) Provisional application No. 62/681,843, filed on Jun. 7, 2018, provisional application No. 62/719,489, filed (Continued)

(51) Int. Cl.
*F02D 41/00* (2006.01)
*F02D 13/06* (2006.01)

(Continued)

(52) U.S. Cl.
CPC ..... *F02D 41/0087* (2013.01); *F02D 13/0203* (2013.01); *F02D 13/06* (2013.01);

(Continued)

(58) Field of Classification Search
CPC ... F02D 41/008–0087; F02D 2200/025; F02D 2200/10; F02D 2200/101; F02D 2250/28

(Continued)

(56) References Cited

U.S. PATENT DOCUMENTS

2004/0012206 A1* 1/2004 Wakashiro ..... H01M 10/633 290/40 C
2004/0182631 A1* 9/2004 Miyamoto ..... F16F 13/10 180/291

(Continued)

FOREIGN PATENT DOCUMENTS

DE 102013114956 A1 7/2014
EP 2123885 A1 11/2009
JP 2017178016 A * 10/2017

OTHER PUBLICATIONS

International Search Report and Written Opinion for PCT/IB2018/054561; dated Oct. 15, 2018; pp. 1-13.

*Primary Examiner* — Robert A Werner
(74) *Attorney, Agent, or Firm* — Mei & Mark, LLP

(57) ABSTRACT

A method for entering and exiting cylinder deactivation modes in a diesel engine, comprises monitoring an engine speed from an idle engine speed to a governed engine speed and monitoring an engine load. If the monitored engine speed is the idle engine speed up to the governed engine speed, and if the engine load is less than the predetermined low load condition, then implementation of a cylinder deactivation mode is restricted to one of a 2 cylinder deactivation mode, a 3 cylinder deactivation mode, or a 4 cylinder deactivation mode. A cylinder deactivation mode is selected for engine operation among the 2 cylinder deactivation mode, the 3 cylinder deactivation mode, and the 4 cylinder deactivation mode to operate the engine at an effective frequency that avoids two resonant frequencies of the vehicle and to operate the engine below a torsional vibration limit.

25 Claims, 10 Drawing Sheets

Related U.S. Application Data on Aug. 17, 2018, provisional application No. 62/780,171, filed on Dec. 14, 2018, provisional application No. 62/797,481, filed on Jan. 28, 2019, provisional application No. 62/812,951, filed on Mar. 1, 2019.

(51) Int. Cl.
*F02D 19/02* (2006.01)
*F02D 13/02* (2006.01)

(52) U.S. Cl.
CPC ..... *F02D 19/024* (2013.01); *F02D 2200/025* (2013.01); *F02D 2200/101* (2013.01); *F02D 2250/28* (2013.01)

(58) Field of Classification Search
USPC ..... 701/111; 123/198 F
See application file for complete search history.

(56) References Cited

U.S. PATENT DOCUMENTS

2005/0049108 A1* 3/2005 Nishizawa ..... B60L 15/2045 477/37
2005/0211492 A1* 9/2005 Mori ..... B60K 5/1216 180/292
2008/0154468 A1* 6/2008 Berger ..... B60W 20/15 701/54
2009/0292439 A1* 11/2009 Lu ..... F02D 17/02 701/102
2011/0029222 A1 2/2011 Luken et al.
2013/0074809 A1* 3/2013 Nakamoto ..... F02N 19/00 123/478
2015/0369140 A1 12/2015 Wagh et al.
2017/0350333 A1* 12/2017 Glugla ..... F02D 41/0295
2019/0376459 A1 12/2019 Pieczko et al.
2020/0123988 A1* 4/2020 Archer ..... F02D 13/06

* cited by examiner

NVH MANAGEMENT IN DIESEL CDA MODES

PRIORITY

This application is a non-provisional of, and claims benefit of priority of U.S. provisional patent application Ser. No. 62/681,843 filed Jun. 7, 2018, 62/719,489 filed Aug. 17, 2018, 62/780,171 filed Dec. 14, 2018, 62/797,481 filed Jan. 28, 2019, and 62/812,951 filed Mar. 1, 2019, all of which are incorporated herein by reference in their entireties.

FIELD

This application provides methods and systems for avoiding natural frequencies while implementing cylinder deactivation.

BACKGROUND

Cylinder deactivation ("CDA"), where intake and exhaust valves are closed and fuel is shut off while a piston reciprocates in an engine cylinder, has been understood to provide fuel economy benefits over a drive cycle. Challenges exist to implement various CDA modes in light of the noise, vibration, and harshness ("NVH") the vehicle experiences during normal and specialized modes of operation. It has been a long felt need to determine how and when to implement CDA modes when NVH conditions are present during or provoked by those CDA modes.

SUMMARY

For many years, the vehicle industry has studied how to implement CDA, but NVH remains a restrictive issue. While some commercially available gasoline engines operate with cylinder deactivation modes or cylinder cut-out modes, it has been difficult to implement CDA in diesel, off-road, heavy duty, medium duty, machinery, long haul, delivery, and bus applications, among others. The size of the vehicle presents its own significant NVH issues, and compression ignition factors such as cylinder pressures, present unique NVH issues that are not present in gasoline engines.

Inventors have discovered through unexpected results and non-routine experimentation, a technique for calibrating a diesel engine system to avoid deleterious resonance. Methods for operating a vehicle so calibrated have also been developed. The systems and methods provide simplifications over prior art techniques, some of which merely guess at the solutions to the unique NVH issues that diesel engines face.

A method for entering and exiting cylinder deactivation modes in a diesel engine, comprises monitoring an engine speed from an idle engine speed to a governed engine speed and monitoring an engine load. If the monitored engine speed is a governed engine speed or if the monitored engine load is greater than a predetermined low load condition, then full engine operation is implemented and cylinder deactivation modes are exited, or then the engine operation is restricted from entering any cylinder deactivation mode but a coast operation mode. If the monitored engine speed is the idle engine speed up to the governed engine speed, and if the engine load is less than the predetermined low load condition, then implementation of a cylinder deactivation mode is restricted to one of a 2 cylinder deactivation mode, a 3 cylinder deactivation mode, or a 4 cylinder deactivation mode. A cylinder deactivation mode is selected for engine operation among the 2 cylinder deactivation mode, the 3 cylinder deactivation mode, and the 4 cylinder deactivation mode to operate the engine at an effective frequency that avoids two resonant frequencies of the vehicle and to operate the engine below a torsional vibration limit.

A method for entering and exiting cylinder deactivation modes in a four cylinder diesel engine comprises monitoring an engine speed from an idle engine speed to a governed engine speed and monitoring an engine load. If the monitored engine speed is a governed engine speed or if the monitored engine load is greater than a predetermined low load condition, then full engine operation is implemented and cylinder deactivation modes are exited, or then the engine operation is restricted from entering any cylinder deactivation mode but a coast operation mode. If the monitored engine speed is the idle engine speed up to the governed engine speed, and if the engine load is less than the predetermined low load condition, then implementation of a cylinder deactivation mode is restricted to one of a one cylinder deactivation mode, a two cylinder deactivation mode, or a three cylinder deactivation mode. A cylinder deactivation mode is selected for engine operation among the one cylinder deactivation mode, the two cylinder deactivation mode, and the three cylinder deactivation mode to operate the engine at an effective frequency that avoids two resonant frequencies of the vehicle and to operate the engine below a torsional vibration limit.

A method for calibrating an engine for switching among cylinder deactivation modes comprises motoring the engine through speed sweeps and load sweeps. A first resonant frequency can be calibrated at a first engine mount. A second resonant frequency can be calibrated at either a second engine mount or at a flywheel of the engine. Control electronics of the engine can be programmed to monitor an engine load and an engine speed. Control electronics of the engine can be programmed to select a cylinder deactivation mode for engine operation among a 2 cylinder deactivation mode, a 3 cylinder deactivation mode, and a 4 cylinder deactivation mode to operate the engine at an effective frequency that avoids two resonant frequencies of the vehicle and to operate the engine below a torsional vibration limit when a monitored engine speed is between an idle engine speed up to a governed engine speed, and when a monitored engine load is less than a predetermined low load condition.

A diesel engine system can comprise six combustion cylinders configured for combusting injected diesel fuel, four of the six combustion cylinders further configured to selectively enter a cylinder deactivation mode. Control hardware can be connected to the four of the six combustion cylinders, the control hardware configured to monitor an engine speed and an engine load, and when the monitored engine speed is an idle engine speed up to a governed engine speed, the control hardware can be configured to select and implement a cylinder deactivation mode restricted to one of a 2 cylinder deactivation mode, a 3 cylinder deactivation mode, or a 4 cylinder deactivation mode to operate the engine at an effective frequency that avoids two resonant frequencies of the vehicle and to operate the engine below a torsional vibration limit.

A method for entering and exiting cylinder deactivation modes in a diesel engine comprises monitoring an engine speed from an idle engine speed to a governed engine speed and monitoring an engine load. If the monitored engine speed is a governed engine speed or if the monitored engine load is greater than a predetermined low load condition, then full engine operation is implemented and cylinder deactivation modes are exited, or then the engine operation is restricted from entering any cylinder deactivation mode but a coast operation mode. If the monitored engine speed is the idle engine speed up to the governed engine speed, and if the engine load is less than the predetermined low load condition, then implementation of a cylinder deactivation mode is restricted to one of a 2 cylinder deactivation mode, a 3 cylinder deactivation mode, or a 4 cylinder deactivation mode. A cylinder deactivation mode is selected for engine operation among the 2 cylinder deactivation mode, the 3 cylinder deactivation mode, and the 4 cylinder deactivation mode to operate the engine so as to limit the acceleration of the engine in a lateral linear direction and to operate the engine below a torsional vibration limit.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

It is to be understood that both the foregoing general description and the following detailed description are exemplary and explanatory only and are not restrictive of the claimed invention.

DETAILED DESCRIPTION

Reference will now be made in detail to the examples which are illustrated in the accompanying drawings. Wherever possible, the same reference numbers will be used throughout the drawings to refer to the same or like parts. Directional references such as "left" and "right" are for ease of reference to the figures. However, some axis are described in FIG. 2A to orient vibration directions in a front-to-back (X) direction, a side-to-side (Y) direction, and an up/down (Z) direction with respect to a vehicle and its mounted engine. These linear vibrations are oriented with respect to the engine so that vibrations that shake the engine can be correlated to the engine orientation. While an in-line six cylinder engine is shown, an in-line 4 cylinder engine can benefit from the teachings herein, as can other engines having more than 6 cylinders, such as 8, 10 or 12 cylinder engines. The teachings of the even-numbered 6 cylinder engine being scalable to the larger even-numbered 8, 10, & 12 cylinder engines. The in-line 4 cylinder engine having unique use of a one cylinder deactivated CDA mode.

Figure 2A:
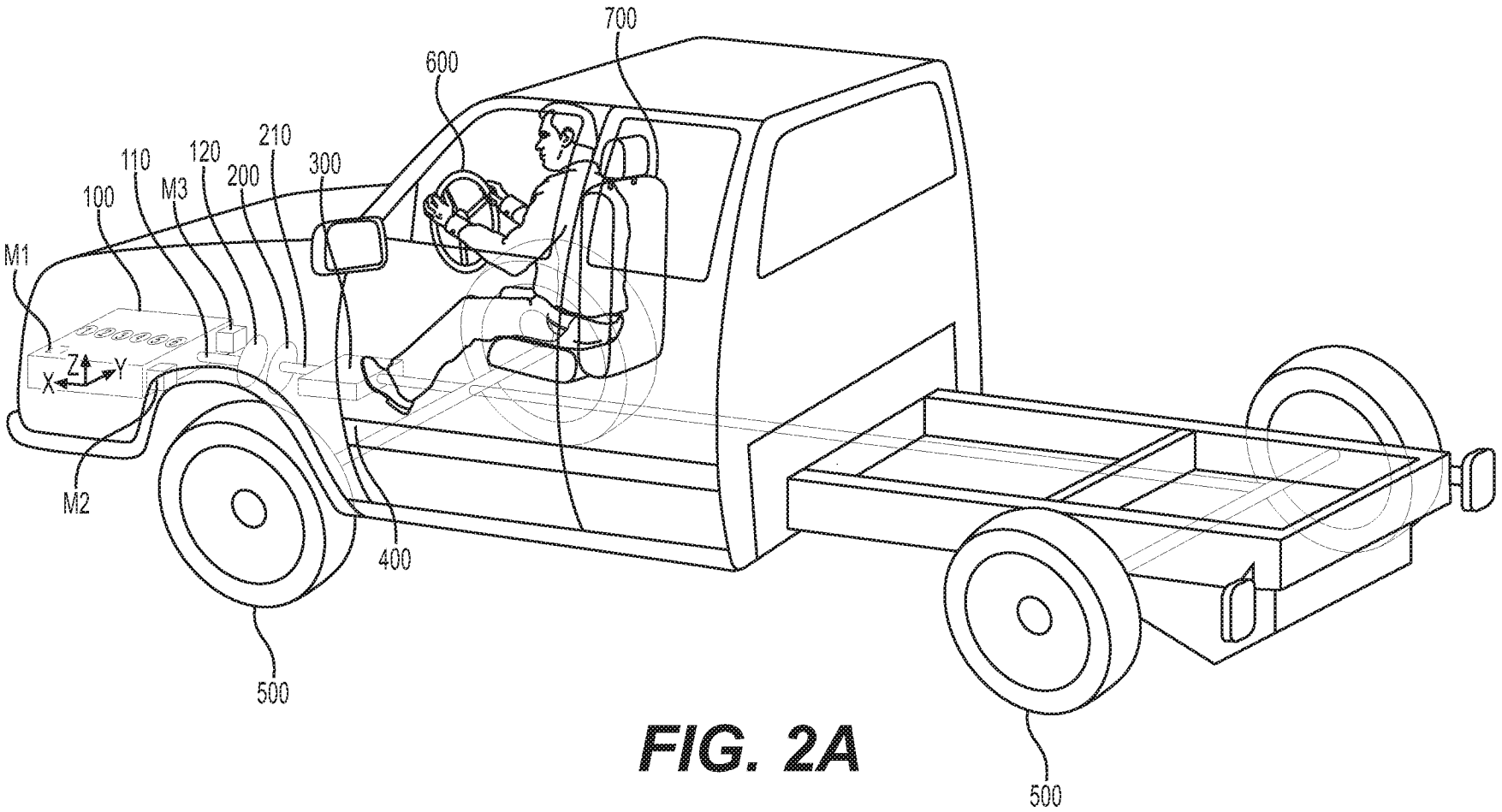
FIG. 2A is a schematic illustrating aspects of a vehicle NVH transmission pathway.

A vehicle system is shown in simplification in FIG. 2A. The powertrain is simplified to include the engine 100 outputting power via crankshaft 110 to flywheel 120. The clutch 200 is shown open and connected to the input shaft 210 of the transmission 300. Drive axles and the driveshaft 400 are shown connected to wheels 500. The connection to steering wheel 600 is omitted for clarity of the image but the steering wheel 600 can receive noise from many aspects of the vehicle. A driver seat 700 experiences NVH, too. Many aspects of a vehicle are omitted to simplify the drawings, but such aspects can be included and are not limited to differentials, power take-off (PTO), brake system, supercharger, cooling systems, battery systems, among many other aspects. The powertrain comprises the minimum components of FIG. 2A to convey motive power from the engine 100 (power source) to the wheels 500. The clutch 200 is shown disconnected from the flywheel 200 (clutch 200 is "open"). The components downstream from the flywheel 200 can collectively be referred to as the drivetrain. The drivetrain resonance can be collectively summed and the natural frequency of the drivetrain can be measured at the coupling between the flywheel 200 and the downstream devices of the drivetrain. Realizing that the drivetrain natural frequency can be summed in this way has not been obvious to others in the art for purposes of determining the CDA mode of engine operation.

Figure 2B:
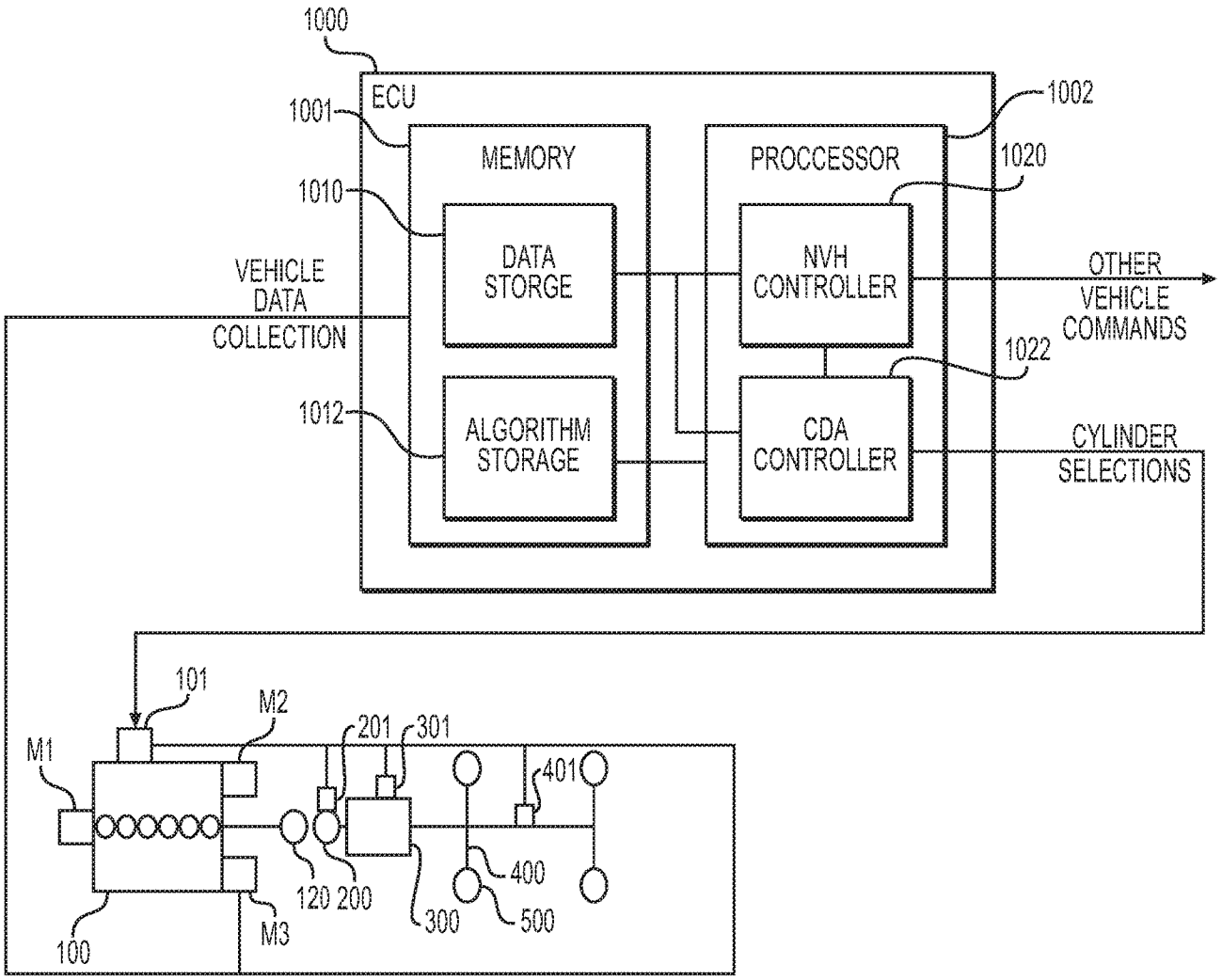
FIG. 2B is a schematic of control electronics.

Turning to FIG. 2B, a schematic of control electronics is shown. Engine mounts, namely front engine mount M1 and left and right rear engine mounts M2, M3, can be placed in locations to stabilize the roll and pitch of the engine. Sensors, such as accelerometers, can be integrated with the engine mounts M1, M2, M3 to monitor the roll and pitch of the engine and can monitor engine mount behavior. One or more engine sensor 101 can monitor engine activity such as valvetrain activity, fueling, piston motion, crankshaft RPMs, among other data. A clutch sensor 201 can monitor the open, close, or slip positions of the clutch 200. One or more transmission sensor 301 can monitor the gear selection, neutral position, operating conditions, among other aspects of transmission operation. One or more drivetrain sensor 401 can monitor the axles, wheels, brakes, and other chassis activity, for example.

Each of the sensors can feed vehicle data collected from the vehicle to one or more on-board or networked computing devices. An electronic control unit ("ECU") 1000 in this example is on-board, though it can be networked with so called cloud computing, including GPS or other location services, fleet management applications, among others. Each of the sensors can be bi-directional and receive commands from the ECU 1000 and so the sensors can also comprise an affiliated or integrated actuator. Example actuations can comprise adjusting the engine mounts, directing valvetrain or fuel injection, implementing failsafes, opening or closing the clutch, changing transmission gear or selecting a neutral position, opening or closing a differential, PTO, brake caliper, wheel hub, among others. Numerous manifestations of valvetrains can be used with the disclosure, and the engine sensor 101 is representative of the myriad combination of control devices that can be actuated to implement combustion, fueling, and cylinder deactivation, among other techniques such as engine braking, early or late valve opening or closing strategies, among others.

The collected vehicle data can be stored in a memory device 1001, which can comprise a data storage section 1010 and an algorithm storage section 1012, for example. A processor-executable control algorithm stored in a memory device can be configured for operating an engine in a cylinder deactivation mode comprising any of the methods disclosed herein.

One or more processing devices can be included to process the stored data and the stored algorithms. Processor 1002 comprises in the example an NVH controller 1020 that can process data and output other vehicle commands to the actuators integrated or affiliated with the sensors. The other vehicle commands can, for example, mitigate NVH to the seat 700 and steering wheel 600 of the vehicle. For example, a damping system can be activated, a driveline component can be adjusted, or an accessory or other vehicle system can be adjusted, among others. Only so much of the vehicle NVH can be ameliorated by the other vehicle commands. The engine itself can be a contributor to the NVH, and so a CDA controller 1022 can implement cylinder selections on the valvetrain of the engine 100 to operate the vehicle within NVH thresholds as detailed more hereinbelow.

The CDA controller 1022 can comprise numerous hardware configurations, including sub processors, networked computing devices, among others. The operation mode of the vehicle can be processed using the control algorithms and CDA modes can be selected, or all-cylinder firing modes can be selected, and various cylinder activation techniques can be implemented as further disclosed herein.

Figure 1:
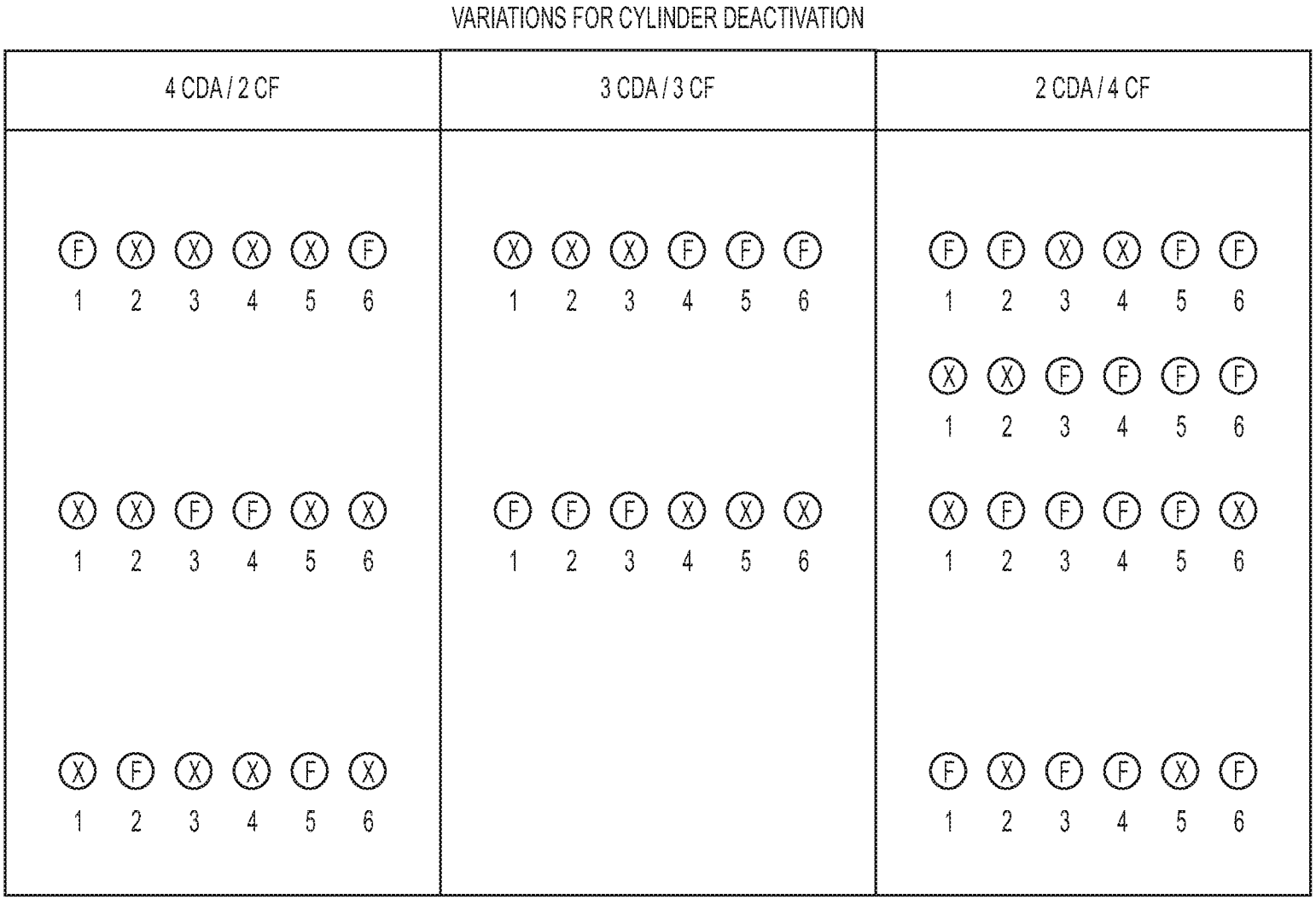
FIG. 1 is a table illustrating variations for cylinder deactivation.

Combinations of variable valve actuation (WA) hardware on a valvetrain can enable an engine to switch between operating modes. Capsules, latches, rocker arms, roller lifters, switching roller finger followers, cams, solenoids, oil control valves, among others can be used with the engine 100 to open and close intake and exhaust valves paired with cylinders 1-6. The cylinders can comprise a single intake valve or pairs of intake valves per cylinder, likewise, single exhaust valve or pairs of exhaust valves per cylinder 1-6. FIG. 1 shows example cylinder variations for cylinder deactivation modes and the WA hardware can be configured to implement the fired "F" or deactivated "X" cylinder combinations. Cylinder deactivation modes ("CDA") can comprise engine operation where intake and exhaust valves are closed and fuel is shut off while a piston reciprocates in an engine cylinder. The CDA modes disclosed herein can comprise low pressure charge trapping, also known as residual exhaust gas CDA. High pressure charge trapping is not excluded, nor are techniques "topping off" cylinder pressures with fuel injections or cylinder "burps."

The first column of FIG. 1 shows different cylinder combinations that can occur when four cylinders are deactivated in a cylinder deactivation mode (CDA) while two cylinders are fired in a cylinder firing mode (CF) (4CDA/2CF). The second column shows different cylinder combinations that can occur when three cylinders are deactivated while two cylinders are fired (3CDA/3CF). The third column shows cylinder combinations that can occur when two cylinders are deactivated in a cylinder deactivation mode while four cylinders are fired in a cylinder firing mode (2CDA/4CF).

Inventors have recognized that there is an equivalence between cylinder deactivation modes, such that NVH in an in-line engine can switch between which cylinders are in firing mode and which cylinders are in CDA mode. As recognized, the NVH for having cylinders 1-3 active in cylinder firing mode and cylinders 4-6 deactivated in CDA mode is the same as having cylinders 4-6 in cylinder firing mode and cylinders 1-3 in CDA mode. Also, the NVH response has equivalence when cylinders are as indicated in Column 1 of FIG. 1 (cylinders 1 & 6, cylinders 3 & 4, and cylinders 2 & 5 in cylinder firing mode while the remainder are in CDA mode). Likewise, Column 3 of FIG. 1 has NVH equivalence among the 2CDA/4CF modes illustrated. This provides a valuable diesel engine system.

In one alternative, instead of costly WA on each of the cylinders of the valvetrain, an option that is certainly beneficial and contemplated as an embodiment of this disclosure, a diesel engine system can comprise CDA hardware on less then all of the cylinders of the valvetrain. One or two or more cylinders can be provided with a basic set of hardware, or an engine braking set of hardware, for example, while other cylinders provide the CDA modes disclosed herein.

As one example, an engine system comprising six combustion cylinders can be configured for combusting injected diesel fuel on all six of the combustion cylinders. Only four of the six combustion cylinders can be further configured to selectively enter a cylinder deactivation mode. Control hardware connected to the four of the six combustion cylinders can be configured to monitor an engine speed and an engine load via the one or more engine sensors 101, and when the monitored engine speed is an idle engine speed up to a governed engine speed, the control hardware can be configured to select and implement a cylinder deactivation mode restricted to one of a 3 cylinder deactivation mode or a 4 cylinder deactivation mode to operate the engine at an effective frequency that avoids two resonant frequencies of the vehicle and to operate the engine below a torsional vibration limit. Such configuration is shown in Columns 1 and 2 of FIG. 1.

As another example, an engine system comprising six combustion cylinders can be configured for combusting injected diesel fuel on all six of the combustion cylinders. Only five of the six combustion cylinders can be further configured to selectively enter a cylinder deactivation mode. Control hardware connected to the five of the six combustion cylinders can be configured to monitor an engine speed and an engine load via the one or more engine sensors 101, and when the monitored engine speed is an idle engine speed up to a governed engine speed, the control hardware can be configured to select and implement a cylinder deactivation mode restricted to one of a 2 cylinder deactivation mode, a 3 cylinder deactivation mode, or a 4 cylinder deactivation mode to operate the engine at an effective frequency that avoids two resonant frequencies of the vehicle and to operate the engine below a torsional vibration limit. Such configuration is shown in the combination of the first row of Column 1 and the second rows of Columns 2 & 3 of FIG. 1.

Benefits inure because, when the diesel engine system further comprises a firewall, it is easier to install and service the WA valvetrain. The four of the six combustion cylinders (cylinders 1-4) or the five of the six combustion cylinders (cylinders 1-5) further configured to selectively enter a cylinder deactivation mode can be installed and configured with the WA hardware farthest from the firewall. The two or one cylinders (cylinders 5 & 6 or cylinder 6) of the six combustion cylinders not configured to selectively enter a cylinder deactivation mode are nearest to the firewall. In an alternative, the two or one cylinders can be configured for engine braking or a specialty process such as reverse breathing, rebreathing, early or late intake or exhaust valve opening or closing, among others. With appropriate hardware selection, the deactivatable cylinders can be configured to additionally provide engine braking. It is possible to provide for 2-stroke engine braking, permitting braking on each reciprocation of the piston.

Variant methods of implementing multi-cylinder cylinder deactivation modes in a functioning 6-cylinder engine can comprise switching between equivalent three-cylinder firing modes, wherein cylinders 1-3 of the 6-cylinder engine firing are switched between cylinders 4-6 of the 6-cylinder engine firing.

Other variant methods of implementing multi-cylinder cylinder deactivation modes in a functioning 6-cylinder engine can comprise switching between equivalent two-cylinder cylinder firing (CF) modes, wherein cylinders 1 &

6 of the 6-cylinder engine are switched between cylinders 2 & 5 of the 6-cylinder engine or are switched between cylinders 3 & 4 of the 6-cylinder engine for the cylinder firing modes. The remaining cylinders (respectively 2-5; 1, 3, 4, & 6; and 1, 2, 5, & 6) can be correspondingly switched in CDA modes.

Other variant methods of implementing multi-cylinder cylinder deactivation modes in a functioning 6-cylinder engine can comprise switching between equivalent four-cylinder firing modes. Cylinders 1, 3, 4, & 6 of the 6-cylinder engine can be switched in cylinder firing mode between cylinders 1, 2, 5, & 6 of the 6-cylinder engine firing. The remaining cylinders (respectively 2 & 5 and 3 & 4) can be correspondingly switched in CDA modes.

Figure 5B:
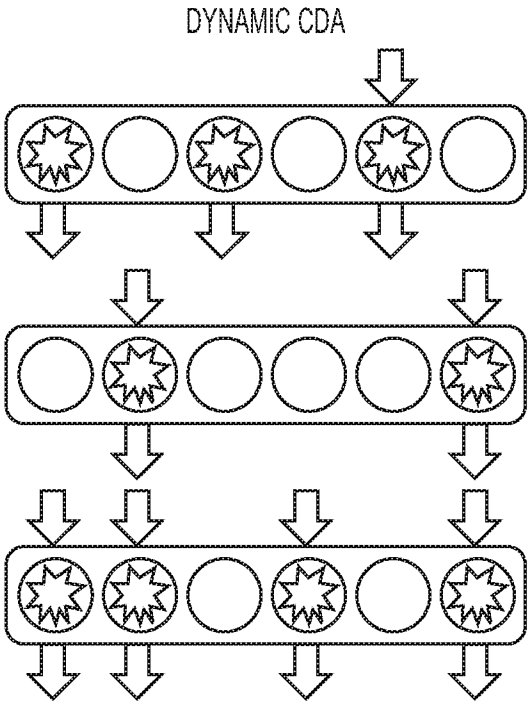
FIGS. 5A & 5B are comparative examples.
Figure 5A:
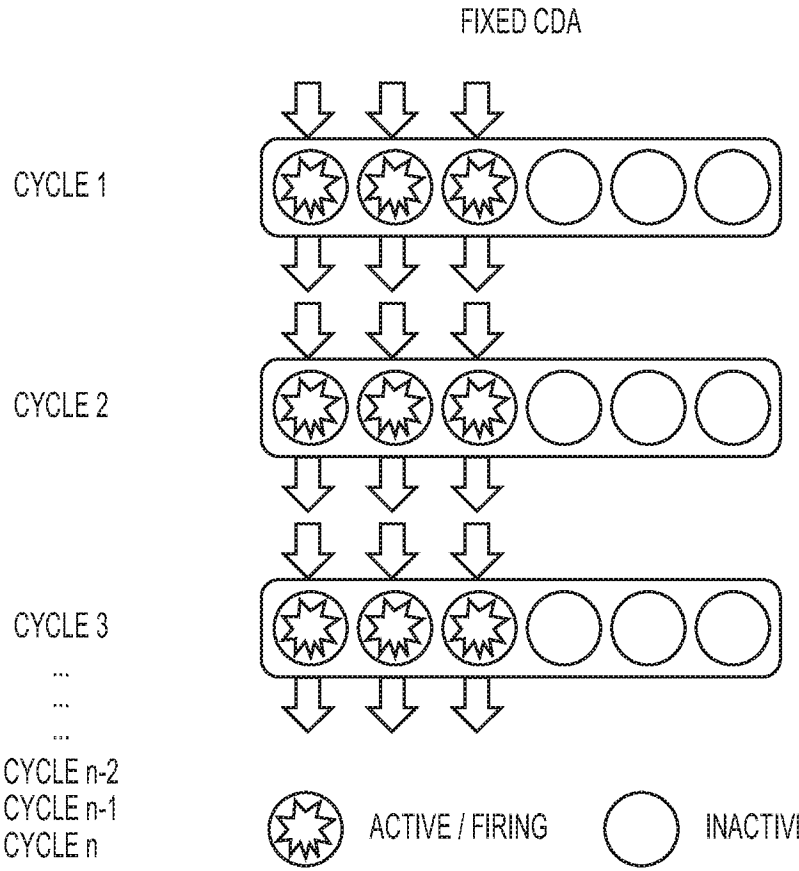

The selected cylinder firing (CF) and CDA mode combinations can be repeated in a so called "fixed" pattern, as detailed in FIG. 5A, where the pattern of cylinders firing (CF) and cylinders in CDA mode repeat from cycle to cycle. Or, the selected cylinder firing (CF) and CDA mode combinations can be varied in a so called "dynamic" CDA pattern, as detailed in FIG. 5B. The dynamic CDA pattern can switch among equivalent 2CDA modes, 3CDA modes, or 4CDA modes as detailed above and shown in the columns of FIG. 1, or the dynamic CDA pattern can switch among 2CDA modes, 3CDA modes, or 4CDA modes as shown in FIG. 5B.

Figure 4A:
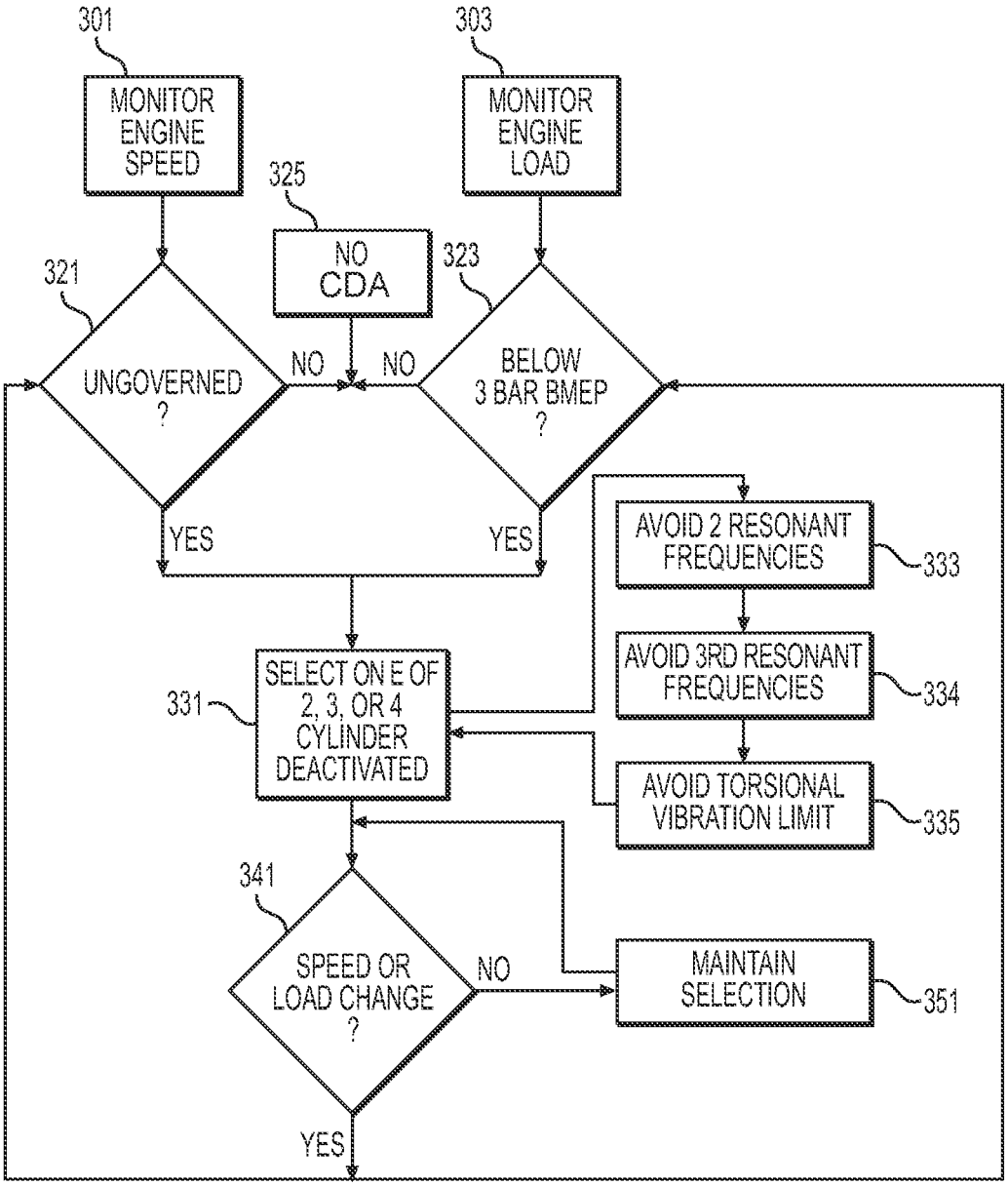
FIGS. 4A & 4B are flow diagrams of methods disclosed herein.
Figure 4B:
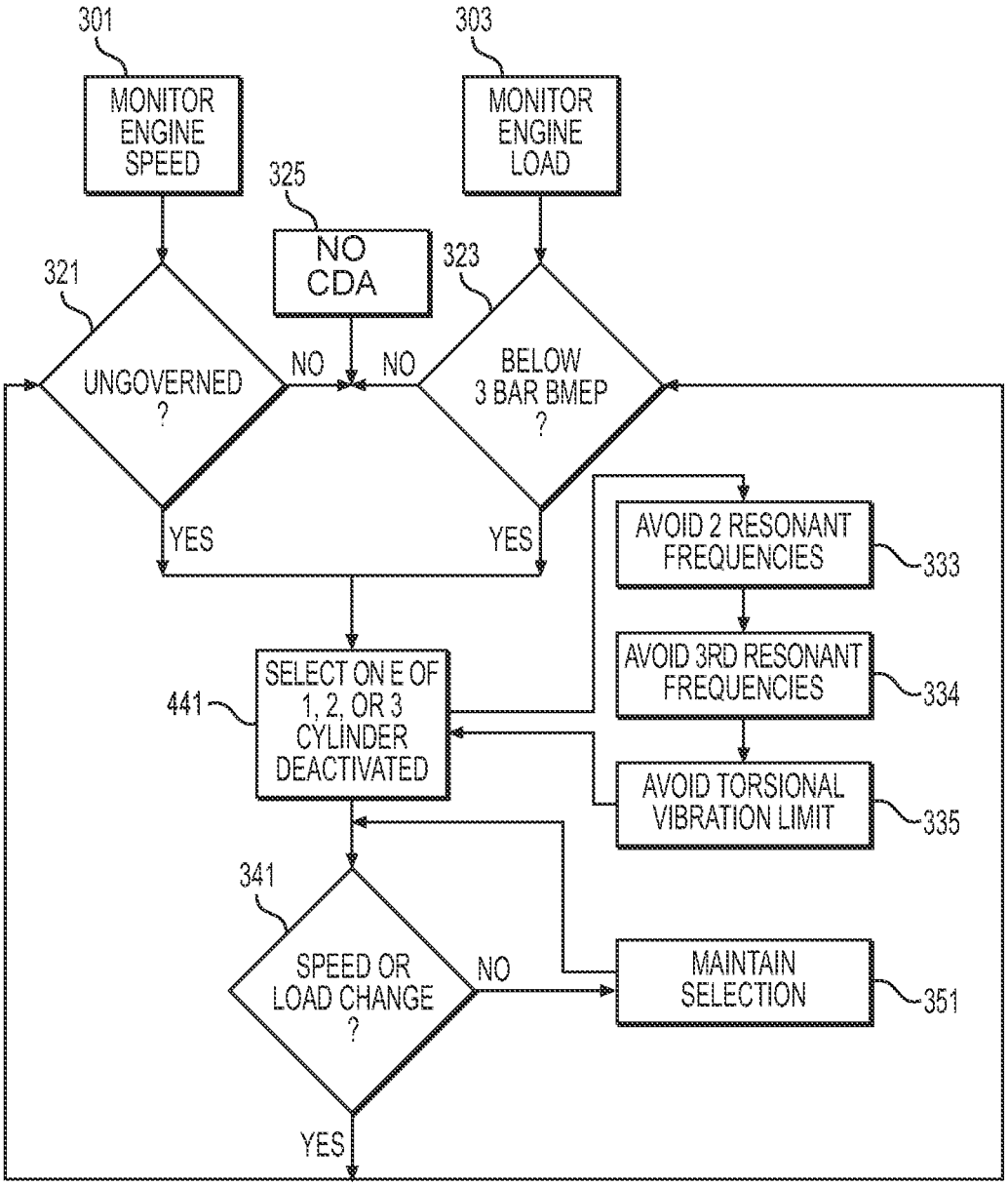

Additional methods for entering and exiting cylinder deactivation modes in a diesel engine can comprise steps as shown in FIGS. 4A & 4B. FIG. 4A pertains to 6-cylinder in-line engines and can pertain to camless or cam engines. Even cylinder increments, 8, 10, 12 . . . cylinder engines can benefit from the teachings of FIG. 4A. FIG. 4B pertains to 4-cylinder in-line engines, which can also be cam less or cam style.

In order to satisfy NVH satisfactorily, the method of FIG. 4A removes permutations of engine modes where only one cylinder is in CF mode and where only one cylinder is in CDA mode. This is a deviation from prior art solutions that inventors hereof have determined alleviates NVH and improves the accessibility and operability of CDA modes in diesel engines comprising 6 or more even numbered cylinders. Limiting the CDA modes to less than all available CDA modes for the number of engine cylinders offers simplifications to improve processing speed and implementation of CDA modes in diesel engines.

More complex methods can comprise 5CF/1CDA mode or 1CF/5CDA mode, but complexity in limiting the time in these modes must be built in, making these modes non-preferred but usable with the teachings herein.

While many vehicle operation aspects can influence NVH, many operations can be summed and aggregated such that the burden of processing and monitoring data is simplified. Inventors have determined that driveline NVH can be summarily addressed as a single natural frequency problem and the engine NVH can be addressed as another natural frequency problem. While others in the art have addressed a smattering of vehicle operation aspects, a simplified approach has long been desired so as to improve processing speeds and reduce processing burdens. The disclosure herein yields these long felt needs in the art.

So, monitoring an engine speed from an idle engine speed to a governed engine speed as in step 301 provides vehicle data on the rotations per minute (RPMs) of the engine crankshaft. The engine has an operating range from zero RPMs to a factory limit. The engine is governed not to exceed the factory limit. So the methods herein apply to the full operating range of the engine RPMs. If the engine is operating ungoverned, as in the decision step 321, the method for implementing CDA modes can proceed, otherwise, no CDA is permitted in step 325.

Again, in order to simplify the implementation of cylinder deactivation modes and address a market-adoption hurdle, the methods herein can comprise monitoring an engine load. Built in to the method is a calibratable delineation of engine load. A decision step 323 analyzes the collected vehicle load data. If it is above the calibratable limit, no CDA modes are permitted in step 325. If the vehicle load is below the calibratable limit, then the method can continue. In FIG. 4A, the calibratable limit is shown as 3 bar BMEP. The brake mean effective pressure (BMEP) provides a standardization for the engine so that the methods herein can be scaled to other engine sizes. Thus, the disclosure is not limited to 3 bar BMEP. In some instances, the CDA mode limit can be reached at, for example, 2 bar BMEP or 4 bar BMEP, among others, including fractions thereof.

The load limit is useful for many implementations. For example, having a load-related limit of 2 bar BMEP for using two cylinder firing mode and 4 cylinder CDA mode 2CF/4CDA prevents the use of a CDA mode that cannot satisfy the torque output of the engine under some operating conditions. The load limit can also correlate to linear vibrations and effective frequencies for provoking undesired resonance in the vehicle. The load limit can also correlate to a torsional vibration limit, wherein a higher load than the load limit excites undesired resonance in the vehicle. Lower load limits can be selected because it can be possible to adequately heat the engine after-treatment at a low load limit such as 2 or 3 bar BMEP. However, a CDA mode can be selected for load limits up to, for example, 3.75 or 4 bar BMEP for NVH considerations in avoiding resonances. It can also be desired to improve driver experience, and so a load limit can be selected that permits smoothing or selected lowering of NVH at the driver seat 700.

If the monitored engine speed is a governed engine speed or if the monitored engine load is greater than a predetermined low load condition such as the load limit, then full engine operation is implemented in step 325. This can comprise exiting cylinder deactivation modes. Alternatively, the engine operation can be restricted from entering any cylinder deactivation mode but a coast operation mode. Fuel savings techniques such as downhill coast, platooning, among others, can be used if an override is included in the method of FIG. 4A.

If the monitored engine speed is in a range from an idle engine speed up to the governed engine speed, and if the engine load is less than the predetermined low load condition, then implementation of a cylinder deactivation mode is selected in step 331. A modal alignment map can be constructed using a calibration method, and such modal alignment map can be consulted for the CDA mode selection. The implementation of a CDA mode can be restricted to one of a 2 cylinder deactivation mode, a 3 cylinder deactivation mode, or a 4 cylinder deactivation mode. As described in more detail, selecting a cylinder deactivation mode for engine operation can be done among the 2 cylinder deactivation mode, the 3 cylinder deactivation mode, and the 4 cylinder deactivation mode to operate the engine at an effective frequency that avoids two resonant frequencies of the vehicle and to operate the engine below a torsional vibration limit.

With a CDA mode selected, the method can further comprise step 341 for further monitoring the engine speed and the engine load. If there is no change, the selection can be maintained in step 351 and a monitoring loop can occur.

Alternatively, a method consistent with that of FIG. 5B or that explained above for the columns of FIG. 1 can be implemented, and the equivalent CDA modes can be dynamically switched. So, step 331 can institute a "fixed" CDA mode, where every cycle of the engine utilizes the same cylinders firing and deactivated until a speed or load change is detected in step 341. Or, step 331 can institute a "dynamic" CDA mode where two or more of the 2, 3, or 4 cylinder CDA modes are switched among so long as the engine speed and engine load requirements are met for the two or more CDA modes, or the "dynamic" CDA mode can select one of the 2, 3, or 4 cylinder CDA modes and switch among equivalents listed in the columns of FIG. 1. When a change in engine speed or engine load is detected, the method can loop back to steps 321& 323 to check whether CDA modes should be exited or whether a new CDA mode or new combination of CDA modes is to be selected. So, a change in either the engine speed or the engine load can result in switching the cylinder deactivation mode to another of the 2 cylinder deactivation mode, the 3 cylinder deactivation mode, and the 4 cylinder deactivation mode.

A 4-cylinder engine method is outlined in FIG. 4B. Many steps are identical to those in FIG. 4A. However, the method for a 4-cylinder engine permits a CDA mode selection where only one cylinder is firing 1CF and 3 cylinders are in CDA mode. Also, three cylinder firing 3CF and one cylinder in CDA mode 1CDA is permitted. Such can be seen in the example of FIG. 3C. If the monitored engine speed is the idle engine speed up to the governed engine speed, and if the engine load is less than the predetermined low load condition, then implementation of a cylinder deactivation mode is made in step 441. A modal alignment map can be consulted as part of the selection step for the CDA mode. CDA mode is restricted to one of a one cylinder deactivation mode, a two cylinder deactivation mode, or a three cylinder deactivation mode. Should a change in engine speed or engine load be determined in step 341, the method can loop to exits CDA as described above or to select one or one or more different cylinder deactivation mode for engine operation among the one cylinder deactivation mode, the two cylinder deactivation mode, and the three cylinder deactivation mode to operate the engine at an effective frequency that avoids two resonant frequencies of the vehicle and to operate the engine below a torsional vibration limit.

Several systems and methods can be comprised to effectively implement CDA modes in spite of NVH issues. And, it is possible to maintain acceptable NVH in a heavy duty or medium duty truck using CDA modes below 3 bar BMEP. Solutions will be discussed in more detail in the following tables and Figures.

Studying the NVH issues surrounding CDA modes yield unexpected and at times surprising results that resulted in determining how to switch CDA modes and avoid negative NVH issues. Such study included seat track studies to understand the NVH impact on the driver seat 700. The seat track being a part of the driveline 400 downstream from the engine 100, it was determined that the engine mounts M1, M2, M3 contribute to an unexpected quantity of NVH during low load CDA modes.

Acceptability standards can be applied for linear vibration felt at the driver seat track. It has been determined that additional seat dampening may be needed, or attention can be had to the vehicle's rigid body modes in order to provide an acceptable driver experience at idle speeds.

Methods and systems for switching CDA modes throughout the operating range have been determined to limit vibrations felt at the driver seat track. The methods are based on vehicle data, where many more components are in play than just the engine mount resonance and driveline resonance.

Vehicle systems and methods enable the use of CDA which utilizes the least common denominator between torsional vibration and linear vibration (seat track, steering wheel, mirrors, etc) in order to provide an acceptable driving experience to the operator as well as prevent any premature failures due to high driveline loads.

In a first example, the parameters a include 13L engine running in a heavy duty truck with criteria as follows:

6 CF ("cylinders firing") below 800 rpm 3 or 6 CF from 800 rpm to 1150 rpm 2,3,4, or 6 CF from 1150 rpm to 1350 rpm 2,4, or 6 CF above 1350 rpm In one aspect, it is possible to operate the vehicle to avoid any resonant frequency, more specifically, to avoid engine mount and driveline resonant frequency in order to detach the vibration path of the CDA mode to the vehicle cab and alleviate resonance at the driver seat 700.

In general, we choose our mode of operation such as to avoid primary and secondary resonant frequencies of the system (harmonics). We also choose our mode of operation such that the level of vibration felt at the driver seat 700 is below the acceptance criteria, for example, as measured by a Driveline Vibration Analyzer (DVA) tool. Peaks in torsional vibration can be related to driveline resonances specifically.

In the first example 13L 6-cylinder in-line engine, analysis has shown that the vehicle motor mounts M1, M2, M3 had resonant frequencies of 29 Hz for the front mount M1 and 19 Hz for the left/rear mounts M2, M3. Due to this, 3CF has a resonance on the left/right mounts M2, M3 at 700-800 rpm, which adversely affects linear vibration. At 1150 rpm, the front mount M1 has a resonance for 3CF which doesn't adversely affect linear vibration, nor does the left/right mounts M2, M3 affect 2CF or 4CF modes at the same speed. However, effects at 2CF and 4CF at the idle speed causes the NVH results to be unacceptable. Linear vibration at the left/right mounts M2, M3 has more of an effect on linear vibration than the front mount M1.

One method for selecting 2, 3, or 4 CF (selecting one of 4CDA, 3CDA, or 2CDA for the CDA mode) at an idle speed of 650 to 800 rpm would be to tune the left/right motor mount frequency to 15 Hz, such as to enable 3CF operation above 650 rpm, and to enable 2CF or 4CF operation between 850 and 950 rpm.

Table 1 shows data for example 1, having normal 6 cylinders firing 6CF contrasted against 3CF, 4CF, 2CF (corresponding to 3CDA, 2CDA, & 4CDA modes respectively) for several RPMs. 3CDA mode excites resonance at a frequency of 13.75 Hz to 15 Hz when the engine is at 550 RPM to 600 RPM. When implementing the methods disclosed herein, 3CDA mode would not be selected when the engine is operating at engine speeds of 550-600 RPMs. 4CF & 2CF (corresponding to 2CDA mode and 4CDA mode) excite resonance at 850-900 RPMs, and so 2CDA mode and 4CDA mode would not be selected when monitoring the engine speed reveals that the engine is operating at those RPMs.

TABLE 1

| | | | | | | | | | | | | | |
|---|---|---|---|---|---|---|---|---|---|---|---|---|---|
| Normal | 25 | 27.5 | 30 | 33 | 35 | 38 | 40 | 43 | 45 | 48 | 50 | 52.5 | 55 |
| Half | 12.5 | 13.75 | 15 | 16 | 18 | 19 | 20 | 21 | 23 | 24 | 25 | 26.3 | 27.5 |
| 4 CF | 8.3333333 | 9.16667 | 10 | 11 | 12 | 13 | 13 | 14 | 15 | 16 | 16.7 | 17.5 | 18.3 |
| 2 CF | 8.3333333 | 9.16667 | 10 | 11 | 12 | 13 | 13 | 14 | 15 | 16 | 16.7 | 17.5 | 18.3 |
| RPM | 500 | 550 | 600 | 650 | 700 | 750 | 800 | 850 | 900 | 950 | 1000 | 1050 | 1100 |

A selection method consistent with step 331 can comprise using any one of the 3CDA, 2CDA, or 4CDA modes from zero engine RPMs up to 500 RPMs, between 650 to 800 RPMs or above 950 RPMs to the governed engine speed so long as engine load limit has not been reached. Using only one of 2CDA mode or 4CDA mode from 550-600 RPMs can be selected so long as engine load limit has not been reached. Between 850-900 RPMs, 3CDA mode can be used within the engine load limit.

Another solution would be to tune the left/right motor mount resonant frequency to 12 Hz, such as to enable 3CF mode (3CDA mode) above 500 RPM, and to enable 2CF and 4CF (4CDA mode or 2CDA mode) below 600 RPM and above 750 RPM as shown in Table 2.

TABLE 2

| | | | | | | | | | | |
|---|---|---|---|---|---|---|---|---|---|---|
| Normal | 25 | 27.5 | 30 | 33 | 35 | 38 | 40 | 43 | 45 | 48 |
| Half | 12.5 | 13.75 | 15 | 16 | 18 | 19 | 20 | 21 | 23 | 24 |
| 4 CF | 8.3333333 | 9.16667 | 10 | 11 | 12 | 13 | 13 | 14 | 15 | 16 |
| 2 CF | 8.3333333 | 9.16667 | 10 | 11 | 12 | 13 | 13 | 14 | 15 | 16 |
| RPM | 500 | 550 | 600 | 650 | 700 | 750 | 800 | 850 | 900 | 950 |

A predominant linear vibration direction of interest is the Y-direction, the lateral direction going from side-to-side. CDA mode selections can be restricted in view of the linear vibrations in the Y-direction data, only. This is because all CDA modes are within acceptable NVH limits in the vertical (Z) and front to back (X) directions. Solving for this greatly simplifies the implementation of CDA modes, reduces processing burdens, and increases the speed at which CDA modes can be entered and exited in real time. Calibration techniques for programming engine on-board computers such as ECU 1000 are likewise simplified and less burdensome.

Figure 6:
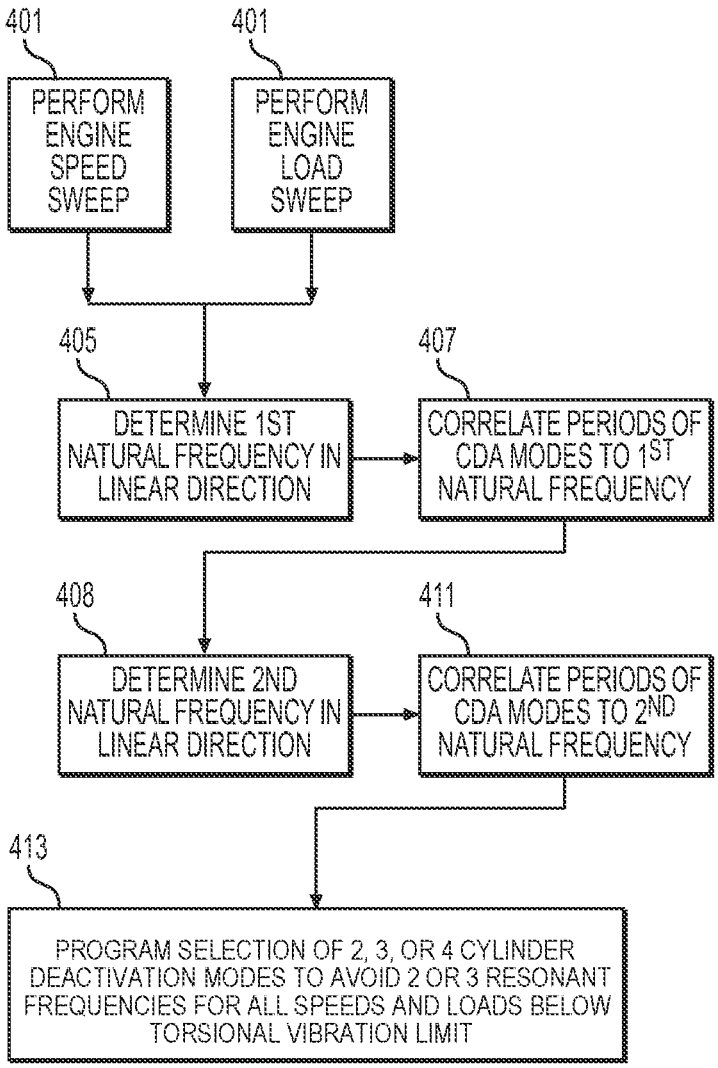
FIG. 6 is a calibration method flow diagram.

Additional seat dampening could be installed to mitigate the Y-direction vibration. For example, seat dampening in the Y-direction could be added to dampen in the 12 Hz to 20 Hz range to enable 3CF mode (3CDA mode), and to dampen the 6 Hz to 14 Hz range to enable 2CF or 4CF mode (4CDA mode or 2CDA mode) (especially focusing in the 8-12 Hz range). In the event rigid body modes are being excited, additional seat dampening will be ineffective. When this is true, a method to find resonant frequencies (such as to avoid them) is to perform a "modal analysis" in order to create a "modal alignment map" to assure all component resonant frequencies are being avoided. This can be part of the calibration method of FIG. 6 and can comprise creation of a 3D lookup table (3D LUT), LaPlace Transform, or matrix analysis to correlate the engine speed, engine load, and CDA modes selectable for the engine speed and engine load.

The calibration method can comprise collecting vehicle data. Such data can comprise collection of the vibration signature of neutral coast. This can enable additional fuel savings selections such ECU 1000 can be programmed for neutral coast having full engine CDA (6CDA mode) with all valves closed and no fuel to the cylinders, or 6 cylinders operating (valves operating and no fuel). 6CDA mode can be preferred to avoid pumping losses and cooling of the after-treatment.

Vehicle data collection can confirm the torsional vibration limit. A load-related limit can be determined, such as 3 bar BMEP, and under that load limit, torsional vibrations for all CDA modes are equal to or lower than the 6 cylinder firing baseline. For example, it can be determined that all CDA modes are well below an exemplary 500 radians per second squared limit.

Torsional vibration for all CDA modes for the operating range of interest (i.e., engine speeds spanning the useful range of RPMs and below 3 bar BMEP) are lower than a 500 rad/s$^2$ limit for diesel engine CDA modes.

Linear vibration modes can be found insensitive to differences in transmission models including AMT transmissions. This is a result of the transmission inertia (from the gears) being insignificant to the overall transmission inertia. This is an aspect of simplifying the study of driveline natural frequencies. It can be determined that torsional vibration of the driveline is insensitive since it is within a good range everywhere in the operating range.

In a second example engine system, CDA modes are explained related to NVH for a 6.7L 6-cylinder in-line cam less engine. In another aspect, a vehicle dataset is used to select methods and systems for switching CDA modes. It is unique in that it comprises different driveline and engine mount resonant frequencies. Yet, we are still able to switch CDA modes to avoid resonances using the methods and calibrations disclosed herein. The implementation is also on a medium duty engine as compared to a heavy duty engine as in Example 1. Teachings can be extrapolated to the heavy duty engine and vice versa.

Driveline resonance of a 6.7L engine running in a dyno test cell system is 5.4 Hz while the motor mounts resonance is 17.5 Hz. While the driveline resonance is not excited in the typical operating range of a vehicle, the motor mount resonances do appear during normal operating conditions. This aspect permits calibration of an engine system according to a simplified calibration scheme.

A method to avoid motor mount resonance while implementing multi-cylinder cylinder deactivation modes in a functioning cam less engine can comprise avoiding a 3-cylinder firing mode when the crankshaft of the engine is operating from 700-750 RPMs, and further avoiding a 2-cylinder firing mode or a 4-cylinder firing mode when the crankshaft of the engine is operating from 1000-1100 RPMs. Such can be seen in Table 3.

TABLE 3

| | | | | | | | | | | | | | | |
|---|---|---|---|---|---|---|---|---|---|---|---|---|---|---|
| Normal | 25 | 27.5 | 30 | 33 | 35 | 38 | 40 | 43 | 45 | 48 | 50 | 52.5 | 55 | 57.5 |
| Half | 12.5 | 13.75 | 15 | 16 | 18 | 19 | 20 | 21 | 23 | 24 | 25 | 26.3 | 27.5 | 28.8 |
| 4 CF | 8.3333333 | 9.16667 | 10 | 11 | 12 | 13 | 13 | 14 | 15 | 16 | 16.7 | 17.5 | 18.3 | 19.2 |
| 2 CF | 8.3333333 | 9.16667 | 10 | 11 | 12 | 13 | 13 | 14 | 15 | 16 | 16.7 | 17.5 | 18.3 | 19.2 |
| RPM | 500 | 550 | 600 | 650 | 700 | 750 | 800 | 850 | 900 | 950 | 1000 | 1050 | 1100 | 1150 |

A method of implementing cylinder deactivation in an engine can comprise selecting and implementing a cylinder deactivation mode when the engine is operating at idle for linear stability. Linear vibration for CDA modes is similar at loaded idle to the baseline (6CF) condition, except when that CDA mode is operating under a known resonance. For the example 2 engine system, 4CF (2CDA mode), with cylinders 1, 3, 4, and 6 active and firing has the lowest NVH response at idle speed (800 rpm in this case).

Another method of implementing cylinder deactivation in an engine system can comprise switching cylinder deactivation modes to maintain a linear vibration response in the Y-direction below 0.25 g's throughout the typical engine operating range. 0.25 g's is slightly higher than the baseline (6CF) maximum of 0.15 g's, however it provides an acceptable response.

In examples 1 & 2, accelerometers were used to measure linear vibration and speed sensors were used to measure torsional vibration at various locations in the system. Since accelerometers directly measure acceleration, reporting of data was done in both linear acceleration (for linear vibration) and angular acceleration (for torsional vibration). This was not only the most convenient and direct form of measurement, but standards have been developed that utilize acceleration measurements. Equivalents to these measurements, even if requiring conversions to other units are within the teachings of this disclosure. For example, vehicle and engine system response can also be measured by using units of displacement (linear displacement or angular displacement). In some cases evaluating the velocity of the system components may be beneficial as well.

Another method of implementing cylinder deactivation modes in an engine system can comprise inputting an upper boundary and a lower boundary in to an engine calibrator; linearly interpolating a curve between the input upper boundary and input lower boundary; and running cylinder deactivation mode when the engine is operating between the input upper boundary and the input lower boundary. This can be done as when linear vibration and torsional vibration are found to be linearly proportional to engine BMEP (i.e. torque). Engine calibrators can input the lower and upper bound limits while allowing linear interpolation in between. This further simplifies the implementation of CDA in diesel engines.

While the above method operates between boundaries, another method can be devised to operate outside the upper boundary and the lower boundary. The upper boundary and the lower boundary can represent extrema of a resonant frequency range, and the resonant frequency range can be excluded from the CDA mode engine operation as by selecting a CDA mode or engine speed change that moves the effective frequency of the CDA mode that is outside the resonant frequency range.

Hardware system simplifications can be implemented by selection of the control system feedback sensor. Since engine left, engine right, and engine front accelerometers affiliated with engine mounts M2, M3, M1 all measured similar responses, a control system could use a feedback loop on only one location for active vibration control.

A multi-cylinder engine system can comprise multiple cylinders configured for selectively implementing a cylinder deactivation mode; any one of an engine left, an engine right, and an engine front accelerometer; and a feedback loop circuit on a control system connected to the multiple cylinders and connected to the any one of the engine left, the engine right, and the engine front accelerometer, wherein a sensed vibration mode is fed back from the any one of the engine left, the engine right, and the engine front accelerometer to the control system for determining a number of cylinders to select implementation of cylinder deactivation mode on the multiple cylinders. The engine system can be operated so as to limit the acceleration of the engine in a lateral linear direction. For example, it can be beneficial to maintain the linear vibration response under 0.25 g for a monitored engine speed and a monitored engine load.

Another alternative method can comprise avoiding resonant frequencies by increasing the engine speed in a selected CDA mode to adjust the NVH to lower levels. It is calibratable that some CDA modes have less NVH as engine RPMs increase past points of resonant frequencies. So, a CDA mode can be selected and NVH decreased by increasing RPMs beyond where that CDA mode would cause resonance. The effective frequency of the selected CDA mode can be controlled by the engine RPMs. Fuel economy benefits can be obtained even with the increased expenditure of energy if the idle speed is not increased more than 400 RPM over the idle speed needed at the engine load. This also benefits the aftertreatment heat-up by providing more heat.

A method for reducing linear vibration during vehicle idle operation can comprise idling the vehicle; increasing engine rotations per minute above nominal rotations per minute; and entering a CDA mode on the engine, wherein entering the CDA mode comprises closing intake and exhaust valves and suspending fuel injection to the cylinders of the engine. The CDA mode can comprise deactivating one half, one third or two thirds of the cylinders of the engine.

As a corollary, it can be possible to both increase engine RPMs and switch from one CDA mode to another CDA mode to select an effective frequency that lowers NVH in the vehicle system. Increasing engine RPMs can increase the vibration range to a higher frequency, which is more favorable for NVH.

Another method comprises selecting the CDA mode with the highest effective frequency to increase the vibration range to the highest vibration range among the selectable CDA modes.

As mentioned above, FIG. 2A provides a reference to describe linear vibration. Linear vibration can be a catch-all term for vibration in any of the X-Y-Z axes. It is important to note that linear vibration does not include torsional vibration. In the disclosure, torsional vibration measures twisting which revolves around the X axis. Typically, a torsional resonance is induced due to the driveline components. A linear resonance can be impacted by many different components in the vehicle system. So, it was unexpected to see in test results the significance over others of one linear resonance seen in the test cell system. It was correlated to a resonance of the engine mounts. The resonance manifested itself in the Y direction of linear vibration.

Seat track vibrations impacting the driver seat 700 can be considered as linear vibrations. Coupling/decoupling of driveline components, such as clutch and transmission, can be interested in the effects of torsional vibration. These driveline components can have a significant impact on torsional resonances, but have little impact on the linear vibration of the system.

Components that drive linear vibration can comprise, for example, the engine mounts, and it can be understood that some linear vibration in the Y direction is objectionable at idle speeds and linear vibration in the Y direction is the primary driver for selecting a cylinder deactivation mode for an operating engine.

It is possible to limit the influence of torsional vibration as by staying engine operation under 500 rad/s over the engine operating range, which can avoid torsional vibration as a driver for selecting the CDA mode (number of cylinders firing ("CF") or number of cylinders deactivated).

It is possible to ignore seat track X and Z axes when selecting the CDA mode when the X and Z axes do not have enough differentiation between CDA modes and standard operating mode (6 cylinders firing).

At idle speeds, engine mounts can be ineffective at isolating the source of vibration, the engine, from the rest of the system. This lack of isolation is harmonically exciting components at very low frequencies, which component excitations are being transmitted to the cabin and ultimately the driver's seat 700.

The disclosure illustrates that while torsional vibration was thought to be the primary area of focus to develop a solution for implementing CDA modes, the less intuitive Y direction is a driver for selecting CDA operating modes. Also, some artisans think of linear vibration in the vertical (Z) direction, and not the lateral Y direction. This makes the discovery of the NVH source and CDA mode selection driver the result of non-routine experimentation, as others have overlooked the Y direction as the control point for selecting CDA modes.

It can be found that only a single CDA mode can be used at a particular engine speed and engine load, and otherwise all cylinders firing mode must be used in order to satisfy various resonant frequencies. Then it is not possible to select among 2CDA mode, 3CDA mode, and 4CDA mode because only one of those modes is available under the operating conditions. For example, a driver seat 700 can be excited differently than a steering wheel 600 which can be excited differently than the driveline 400 by the same linear vibration originating from an engine mount M1. So, it can happen that a CDA mode is selected that avoids the resonant frequency of the driver seat 700 and that avoids the resonant frequency of the driveline 400. It can alternatively be that the CDA mode avoids the third resonant frequency of the steering wheel 600 for that engine speed and engine load. It can also be found that at an engine speed and engine load, that all three CDA modes are selectable, as none of the CDA modes excite the driver seat 700 or driveline 400, and optionally the steering wheel 600, and three resonant frequencies are avoided.

So, one of the at least two resonant frequencies to avoid can be a linear vibration of the engine in a side-to-side direction. The other one of the at least two resonant frequencies to avoid can arise at a flywheel coupling of the engine.

As seen in Table 4, the at least two resonant frequencies can arise from linear vibrations of the engine in the side-to-side direction, as when a primary harmonic is excited and a secondary harmonic is excited. It is possible that both of the at least two resonant frequencies are linear vibrations of the front engine mount. Tables 1-4 can constitute aspects of a modal alignment map that can be consulted when selecting the CDA mode for engine operation. Consultation can be via hardware comprising one or more 3D LUT, correlated 2D LUTS, networked data files, or other processor accessible constructs known in the art.

Figure 3A:
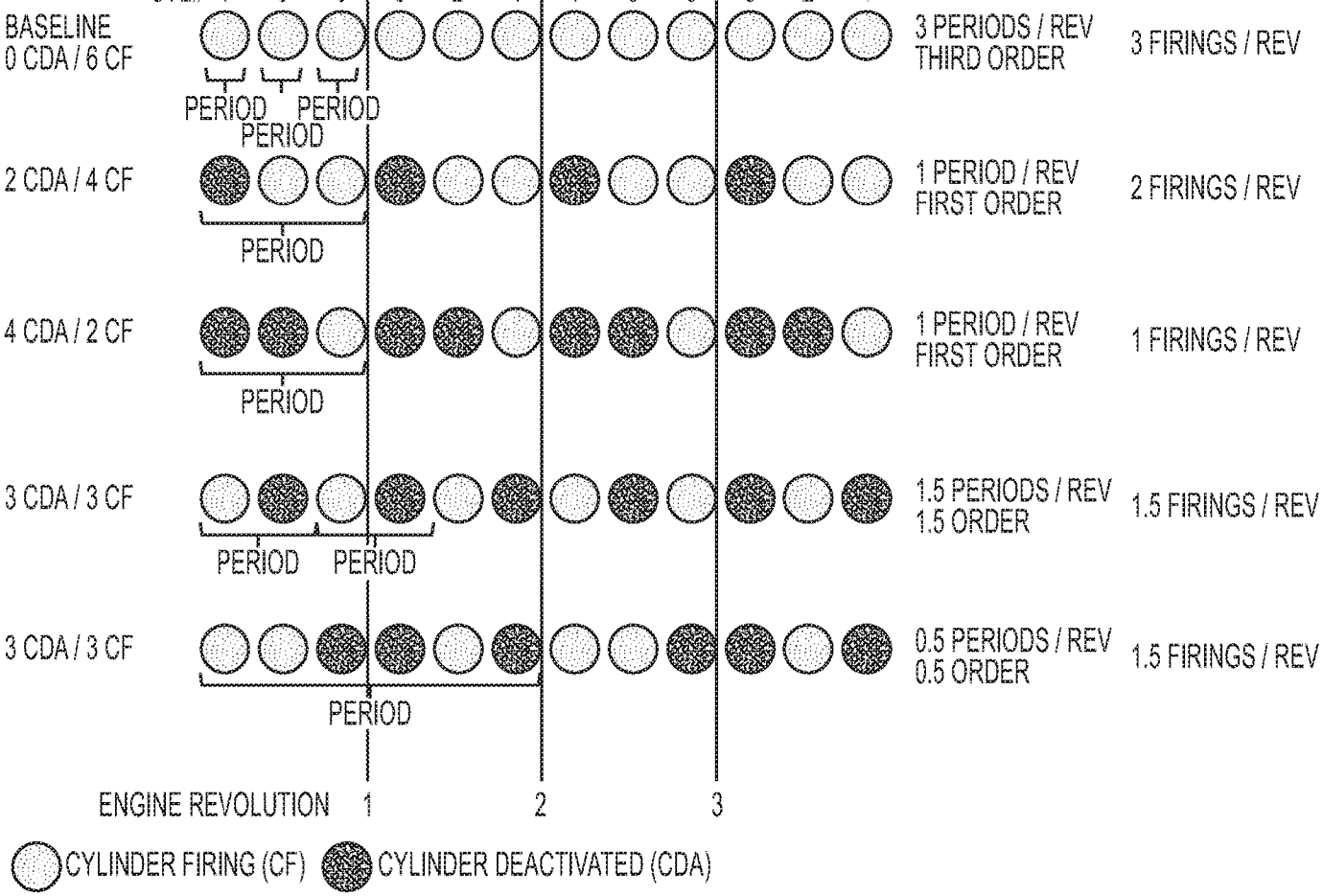
FIG. 3A-3C are cylinder firing and cylinder deactivation combinations illustrative of periodic information.
Figure 3B:
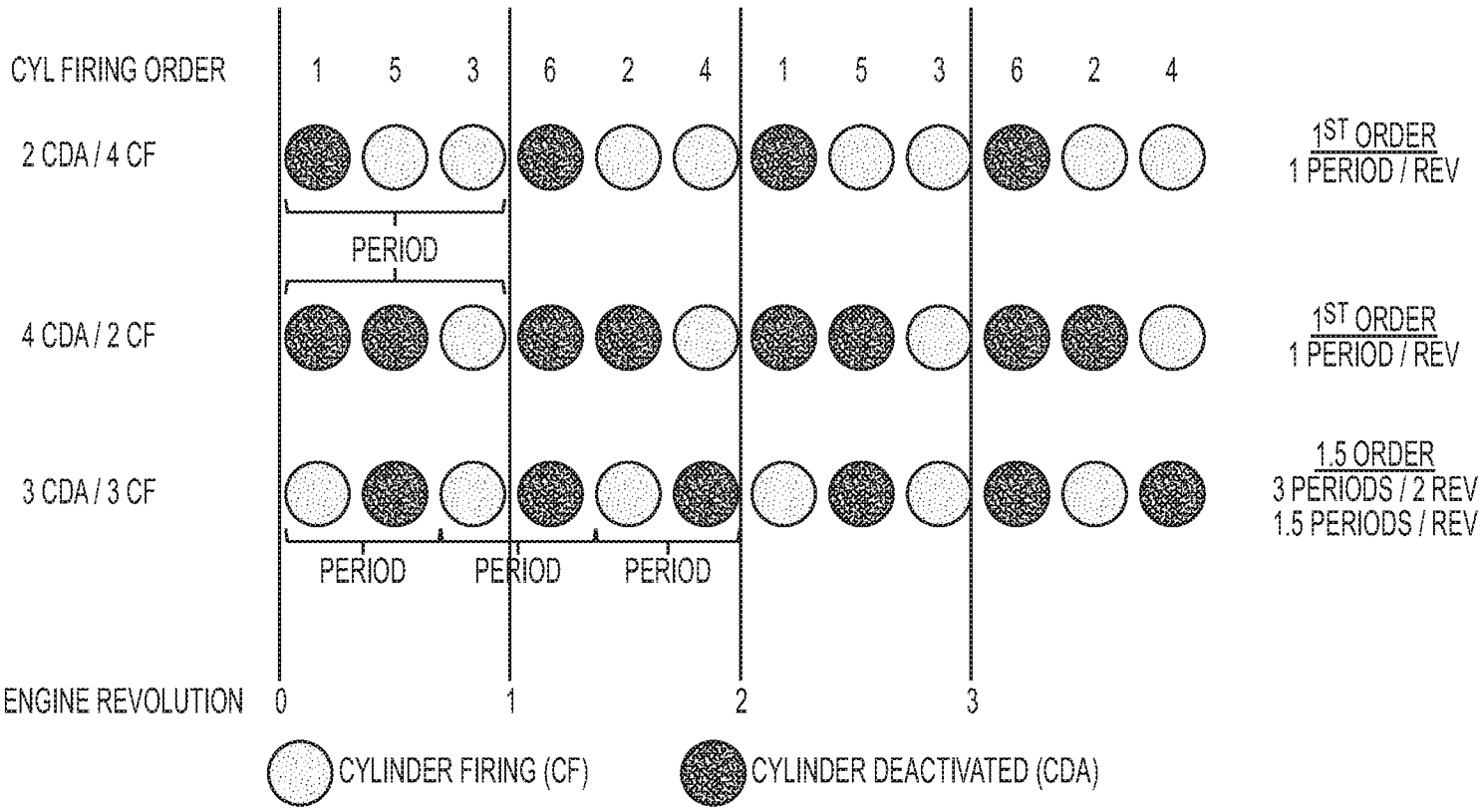
Figure 3C:
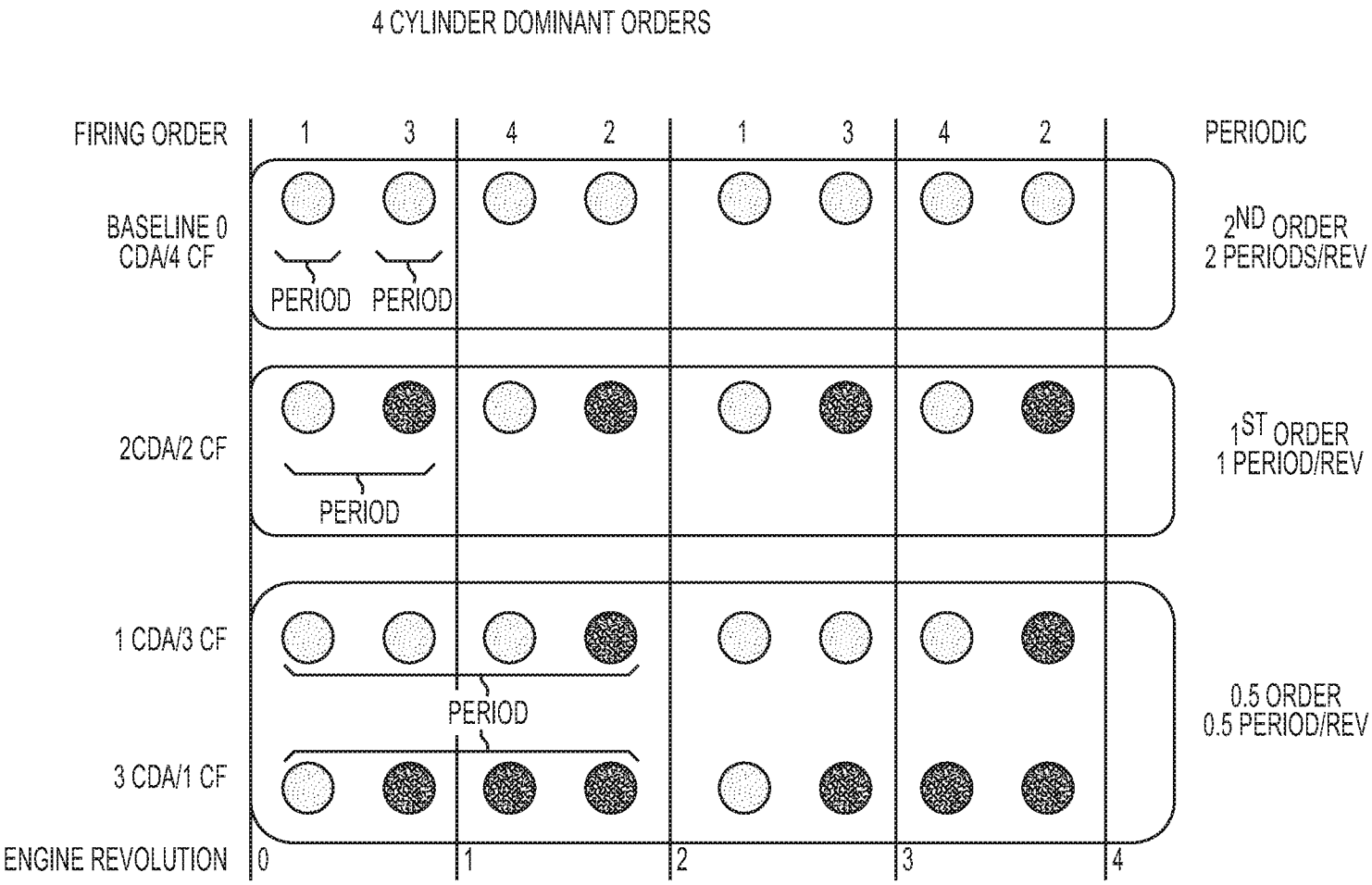

As discussed more with respect to FIGS. 3A-3C and Table 4, the at least two vehicle resonances can correlate to the period of cylinders firing per revolution of a crankshaft of the engine.

The at least two resonant frequencies can comprise a primary resonant frequency and a secondary resonant frequency.

One of the at least two resonant frequencies can be a linear vibration of the front engine mount in a side-to-side direction and the other of the at least two resonant frequencies can be a linear vibration of a rear engine mount in a side-to-side direction.

The CDA modes can be characterized by forcing functions, also known as periodic orders. The periodic orders are summarized for various combinations of cylinders deactivated and cylinders firing in FIGS. 3A-3C. FIGS. 3A & 3B show 6-cylinder engine cylinder combinations with FIG. 3C shows 4-cylinder engine cylinder combinations. The periodic orders and cylinder combinations are compared to baseline all-cylinders firing 6CF mode. Firing periods are denoted for cylinders firing, and these firing periods are correlated to the engine revolutions to arrive at the periodic orders. The periodic orders can be correlated to the resonant frequencies to operate in and to avoid. The modal alignment map can be structured to permit the processor to select CDA modes with acceptable effective frequencies while avoiding resonant frequencies.

Equations for calculating the correlations between the firing orders, the periodic orders, and the effective frequency of the CDA modes can be as in the following examples:

4 Cylinders Firing @ 1000 rpm

EXAMPLE 3

Number of Cylinders Fired Per Revolution (Firing Order)=2

$$f_{firing} = \frac{\text{rpm}}{60\ \text{s/min}} * \frac{\#\ Cyl\ \text{fired}}{rev} = \frac{1000\ \text{rpm}}{60\ \text{s/min}} * 1 = 33.3\ \text{Hz}$$

EXAMPLE 4

Number of Periods Per Revolution (Periodic Order)=1

$$f_{periodic} = \frac{\text{rpm}}{60\ \text{s/min}} * \frac{\#\ \text{periods}}{rev} = \frac{1000\ \text{rpm}}{60\ \text{s/min}} * 1 = 16.7\ \text{Hz}$$

2 Cylinders Firing @ 1000 rpm

EXAMPLE 5

Number of Cylinders Fired Per Revolution (Firing Order)=1

$$f_{firing} = \frac{\text{rpm}}{60\ \text{s/min}} * \frac{\#\ Cyl\ \text{fired}}{rev} = \frac{1000\ \text{rpm}}{60\ \text{s/min}} * 1 = 16.7\ \text{Hz}$$

EXAMPLE 6

Number of Periods Per Revolution (Periodic Order)=1

$$f_{periodic} = \frac{\text{rpm}}{60\ \text{s/min}} * \frac{\#\ \text{periods}}{rev} = \frac{1000\ \text{rpm}}{60\ \text{s/min}} * 1 = 16.7\ \text{Hz}$$

Table 4 summarizes how firing orders and periodic orders correspond to finding the frequencies in Hertz that a CDA mode will yield an effective frequency or a resonant frequency. Through calibration testing, it can be determined that effective frequencies marked with a star (*) in Table 4 are to be avoided, as the effective frequencies are primary resonant frequencies. Primary resonance is excited, also called a first harmonic. Effective frequencies marked with a carat (^) should be avoided, as they are capable of exciting a secondary resonant frequency, also called a second harmonic.

A CDA mode selection strategy can be devised from Table 4. A simple CDA mode selection strategy can be to operate within the dashed areas of Table 4. Three cylinders firing and three cylinders deactivated 3CF/3CDA can be used from start-up of the engine up to 900 RPMs engine speed when the engine load is below 3 or 4 bar BMEP. Then, when engine speed is greater than 900 RPMs, but still within the load limit of 3 or 4 bar BMEP, a new CDA mode can be selected comprising four cylinders firing and two cylinders deactivated 4CF/2CDA.

By quitting 3CF/3CDA at 900 RPM engine speed, two resonant frequency ranges are avoided at the starred (*) frequencies 25.0-27.5 Hz at 1000-1100 RPMs and 33.8-36.3 Hz at 1350-1450 RPMs. By using 3CF/3CDA from start-up through 900 RPM engine speed, a resonant frequency at 700 RPMs and 35.0 Hz is avoided in full-cylinder firing mode 6CF and another resonant frequency range is avoided at 8.3-10.0 Hz from 500-600 RPMs. "Resonant frequency" for a CDA mode can comprise a single Hertz value or a range of Hertz values, as calibration data reveals.

A method for calibrating an engine for switching among cylinder deactivation modes can comprise motoring the engine through speed sweeps and load sweeps as in steps 401 & 403 of FIG. 4. A first resonant frequency at a first engine mount M1 can be calibrated. This can comprise determining one or more natural frequencies in a lateral linear direction as in step 405. The firing orders and periodic orders of a 2 cylinder deactivation mode, a 3 cylinder deactivation mode, and a 4 cylinder deactivation mode can be correlated to the natural frequencies as in step 407.

Calibrating a second resonant frequency at either a second engine mount or at a flywheel of the engine can also be accomplished. Second natural frequencies can be determined as in step 409. These second natural frequencies can be additional lateral linear direction excitations, as when an engine mount such as first engine mount M1 has more than one resonant frequency. Or, the second natural frequency can be attributed to rear engine mounts M2, M3, or can be attributed to the driveline 400 coupling at the flywheel, or can be attributed to a So, when $2^{nd}$ order effects for 2CDA mode are higher than the $1^{st}$ order effects for 3CDA mode, it is possible to switch from 2CDA mode to 3CDA mode.

Further evaluation parameters are disclosed for CDA NVH consideration including observing 3 potential system resonances and evaluating the second harmonic of the active dominant order.

Additional findings from the engine dyno measurements include a method to avoid 3 discreet system resonances—1 torsional resonance (of the coupling) and 2 engine mount resonances (1 of the front engine mount M1 and 1 of the rear mounts M2. M3). A second engine mount resonance can be present in the CDA NVH landscape. Additionally, for higher frequency resonances (i.e. stiff engine mounts), resonances can also be observed in the second harmonic (2× the frequency) of the dominant order of the active CDA mode. For 2 and 4 cylinders firing modes (2CF and 4CF), the second harmonic would be 2nd order. In 3 cylinder firing mode (3CF), the second harmonic would be 3rd order. As disclosed herein, a method can be developed to avoid 3 system resonances. And a method can be developed to account for resonances manifesting in second harmonic orders.

Achieving acceptable NVH is to avoid the engine resonances from engine firing from occurring at the same frequency as the resonances that are connected to the engine. Once the resonances are known, it is desired to avoid the periodic resonances created by various forms of engine firing by switching among various cylinder firing and cylinder deactivation modes, as disclosed herein.

Motoring can be used to find the system resonances. Different loads (i.e. 3 bar BMEP, 2 bar BMEP, etc.) can be used to evaluate the amplitudes of the system resonances and the highest load conditions. Plotting the resonance and amplitude data can yield slopes. An inflection point in the slopes can indicate a need to switch CF/CDA modes to avoid deleterious NVH.

Other implementations will be apparent to those skilled in the art from consideration of the specification and practice of the examples disclosed herein. driver seat 700 resonance, or can be attributed to a steering wheel resonance. The firing orders and periodic orders of the 2 cylinder deactivation mode, the 3 cylinder deactivation mode, and the 4 cylinder deactivation mode can be correlated to the second natural frequencies as in step 411.

Control electronics of the engine 100 can be programmed to monitor an engine load and an engine speed. And, as in step 413, the control electronics can be programmed for selection of the 2 cylinder deactivation mode, the 3 cylinder deactivation mode, and the 4 cylinder deactivation mode to avoid 2 or 3 resonant frequencies for all speeds and loads below a torsional vibration limit such as 500 radians per second squared or another torsional vibration limit calibratable for the engine system. Programming the control electronics of the engine to select a cylinder deactivation mode for engine operation among a 2 cylinder deactivation mode, a 3 cylinder deactivation mode, and a 4 cylinder deactivation mode can be done to operate the engine at an effective frequency that avoids two resonant frequencies of the vehicle and can be done to operate the engine below a torsional vibration limit when a monitored engine speed is between an idle engine speed up to a governed engine speed, and when a monitored engine load is less than a predetermined low load condition.

The calibration scheme can be implemented when motoring the engine system without fuel, as when a dyno is spinning the engine. Or, active engine operation and appropriate sensors, as described above, can be used.

A calibration method can be devised to program the engine control unit (ECU 1000), as by motoring the engine without fuel, then determining resonances above predetermined amplitudes, then programming the ECU to avoid those resonances.

$1^{st}$ order resonances are denoted in Table 4 with stars (*). There is a need to consider $2^{nd}$ order effects when using stiff engine mounts. These are denoted in Table 4 with a carat (^). The resonances are not limited to 1st order effects. When operating with 2CF or 4CF, the $2^{nd}$ order effects could also be avoided. This would break the dashed-line selections in Table 4 and would require more switching back and forth between 3CDA mode and 2 or 4 CDA modes.

TABLE 4

CDA MODES (MOTORING TO 3/4 BAR BMEP

| | RPM | | | | | | | | | | | | |
|---|---|---|---|---|---|---|---|---|---|---|---|---|---|
| | 500 | 550 | 600 | 650 | 700 | 750 | 800 | 850 | 900 | 950 | 1000 | 1050 | 1100 |
| 6 CF (3rd Ord.) | 25.0 | 27.5 | 30.0 | 32.5 | *35.0 | 37.5 | 40.0 | 42.5 | 45.0 | 47.5 | 50.0 | 52.5 | 55.0 |
| 3 CF (1.5 Ord.) | 12.5 | 13.8 | 15.0 | 16.3 | 17.5 | 18.8 | 20.0 | 21.3 | 22.5 | 23.8 | *25.0 | *26.3 | *27.5 |
| 2/4 CF (1st Ord.) | *8.3 | *9.2 | *10.0 | 10.8 | 11.7 | 12.5 | 13.3 | 14.2 | 15.0 | 15.8 | 16.7 | 17.5 | 18.3 |
| 2/4 CF (2nd harmonic of the 1st Order) | 16.7 | 18.3 | 20.0 | 21.7 | 23.3 | 25.0 | 26.7 | 28.3 | 30.0 | 31.7 | ^33.3 | ^35.0 | ^36.7 |
| FINAL CDA MODE SELECTED | 3 Cylinders Firing | | | | | | | | 4 Cyclinders Firing | | | | |

| | RPM | | | | | | | | | | | |
|---|---|---|---|---|---|---|---|---|---|---|---|---|
| | 1150 | 1200 | 1250 | 1300 | 1350 | 1400 | 1450 | 1500 | 1550 | 1600 | 1650 | 1700 |
| 6 CF (3rd Ord.) | 57.5 | 60.0 | 62.5 | 65.0 | 67.5 | 70.0 | 72.5 | 75.0 | 77.5 | 80.0 | 82.5 | 85.0 |
| 3 CF (1.5 Ord.) | 28.8 | 30.0 | 31.3 | 32.5 | *33.8 | *35.0 | *36.3 | 37.5 | 38.8 | 40.0 | 41.3 | 42.5 |
| 2/4 CF (1st Ord.) | 19.2 | 20.0 | 20.8 | 21.7 | 22.5 | 23.3 | 24.2 | 25.0 | ^25.8 | ^26.7 | ^27.5 | 28.3 |
| 2/4 CF (2nd harmonic of the 1st Order) | 38.3 | 40.0 | 41.7 | 43.3 | 45.0 | 46.7 | 48.3 | 50.0 | 51.7 | 53.3 | 55.0 | 56.7 |
| FINAL CDA MODE SELECTED | 4 Cyclinders Firing | | | | | | | | | | | |

What is claimed is:

1. A system for managing cylinder deactivation modes in a diesel engine, comprising:

one or more sensors for monitoring an engine speed from an idle engine speed to a governed engine speed;

one or more sensors for monitoring an engine load; and an electronic control unit for collecting data on the engine speed and engine load and for selecting a cylinder deactivation mode based on the collected data, wherein, when the monitored engine speed is a governed engine speed or when the monitored engine load is greater than a predetermined low load condition, full engine operation and exiting cylinder deactivation modes are implemented, or the engine operation is restricted from entering any cylinder deactivation mode but a coast operation mode;

when the monitored engine speed is the idle engine speed up to the governed engine speed, and when the engine load is less than the predetermined low load condition, a cylinder deactivation mode is implemented and restricted to one of a 2 cylinder deactivation mode, a 3 cylinder deactivation mode, or a 4 cylinder deactivation mode; and the cylinder deactivation mode for engine operation among the 2 cylinder deactivation mode, the 3 cylinder deactivation mode, and the 4 cylinder deactivation mode is selected to operate the engine at an effective frequency that avoids two resonant frequencies of the vehicle and to operate the engine below a torsional vibration limit.

2. The system of claim 1, wherein the torsional vibration limit is 500 rad/s2 at a flywheel of the engine.

3. The system of claim 1, wherein one of the two resonant frequencies is a linear vibration of the engine in a side-to-side direction.

4. The system of claim 3, wherein the other one of the two resonant frequencies arises at a flywheel coupling of the engine.

5. The system of claim 3, wherein the two resonant frequencies arise from linear vibrations of the engine in the side-to-side direction.

6. The system of claim 5, wherein the two resonant frequencies of the vehicle correlate to the period of cylinders firing per revolution of a crankshaft of the engine.

7. The system of claim 5, wherein the two resonant frequencies comprise a primary resonant frequency and a secondary resonant frequency.

8. The system of claim 7, wherein the two resonant frequencies are linear vibrations of a front engine mount.

9. The system of claim 1, wherein the two resonant frequencies are linear vibrations of a front engine mount in a side-to-side direction.

10. The system of claim 1, wherein one of the two resonant frequencies is a linear vibration of a front engine mount in a side-to-side direction and the other of the two resonant frequencies is a linear vibration of a rear engine mount in a side-to-side direction.

11. The system of claim 1, wherein the engine speed and the engine load are further monitored and, when a change in engine speed or engine load is detected, the cylinder deactivation mode is switched to another of the 2 cylinder deactivation mode, the 3 cylinder deactivation mode, and the 4 cylinder deactivation mode.

12. The system of claim 1, wherein the two resonant frequencies are avoided by increasing the engine speed in the selected cylinder deactivation mode to lower the effective frequency of the selected cylinder deactivation mode.

13. The system of claim 1, wherein the engine speed is increased in rotations per minute above the monitored engine speed to increase the effective frequency of the selected cylinder deactivation mode.

14. The system of claim 1, wherein the cylinder deactivation mode is selected with the highest effective frequency to increase the vibration range to the highest vibration range among the selectable cylinder deactivation modes.

15. The system of claim 1, wherein the one or more sensors for monitoring the engine speed comprise an engine sensor, a clutch sensor, a transmission sensor, and a drivetrain sensor.

16. The system of claim 1, wherein the electronic control unit comprises a memory device and a processor.

17. The system of claim 16, wherein the memory device comprises a data storage section and an algorithm storage section.

18. The system of claim 16, wherein the processor comprises a noise, vibration, harshness (NVH) controller for sending vehicle commands.

19. The system of claim 16, wherein the process comprises a cylinder deactivation (CDA) controller for selecting cylinder deactivation modes.

20. A system for managing cylinder deactivation modes in a four cylinder diesel engine, comprising:

one or more sensors for monitoring an engine speed from an idle engine speed to a governed engine speed;

one or more sensors for monitoring an engine load; and an electronic control unit for collecting data on the engine speed and engine load and for selecting a cylinder deactivation mode based on the collected data, wherein, when the monitored engine speed is a governed engine speed or when the monitored engine load is greater than a predetermined low load condition, full engine operation and exiting cylinder deactivation modes are implemented, or the engine operation is restricted from entering any cylinder deactivation mode but a coast operation mode;

when the monitored engine speed is the idle engine speed up to the governed engine speed, and when the engine load is less than the predetermined low load condition, a cylinder deactivation mode is implemented and restricted to one of a one cylinder deactivation mode, a two cylinder deactivation mode, or a three cylinder deactivation mode; and the cylinder deactivation mode is selected for engine operation among the one cylinder deactivation mode, the two cylinder deactivation mode, and the three cylinder deactivation mode to operate the engine at an effective frequency that avoids two resonant frequencies of the vehicle and to operate the engine below a torsional vibration limit.

21. The system of claim 20, wherein the two resonant frequencies comprise a half order resonance or a first order resonance.

22. The system of claim 20, wherein the two resonant frequencies are linear vibrations of the front engine mount in a side-to-side direction.

23. The system of claim 20, wherein the engine speed and the engine load are monitored, and when a change in engine speed or engine load is detected, the cylinder deactivation mode is switched to another of the one cylinder deactivation mode, the two cylinder deactivation mode, and the three cylinder deactivation mode.

24. A system for calibrating an engine for switching among cylinder deactivation modes, comprising:

one or more sensors for motoring the engine through speed sweeps and load sweeps;

an electronic control unit comprising control electronics for calibrating a first resonant frequency at a first engine mount and calibrating a second resonant frequency at either a second engine mount or at a flywheel of the engine;

wherein the control electronics are programmed to monitor an engine load and an engine speed and to select a cylinder deactivation mode for engine operation among a 2 cylinder deactivation mode, a 3 cylinder deactivation mode, and a 4 cylinder deactivation mode to operate the engine at an effective frequency that avoids two resonant frequencies of the vehicle and to operate the engine below a torsional vibration limit when a monitored engine speed is between an idle engine speed up to a governed engine speed, and when a monitored engine load is less than a predetermined low load condition.

25. A system for managing cylinder deactivation modes in a diesel engine, comprising:

one or more sensors for monitoring an engine speed from an idle engine speed to a governed engine speed;

one or more sensors for monitoring an engine load; and an electronic control unit for managing cylinder deactivation modes, wherein, when the monitored engine speed is a governed engine speed or when the monitored engine load is greater than a predetermined low load condition, full engine operation and exiting cylinder deactivation modes are implemented, or the engine operation is restricted from entering any cylinder deactivation mode but a coast operation mode;

when the monitored engine speed is the idle engine speed up to the governed engine speed, and when the engine load is less than the predetermined low load condition, restricting implementation of a cylinder deactivation mode is implemented and restricted to one of a 2 cylinder deactivation mode, a 3 cylinder deactivation mode, or a 4 cylinder deactivation mode; and a the cylinder deactivation mode is selected for engine operation among the 2 cylinder deactivation mode, the 3 cylinder deactivation mode, and the 4 cylinder deactivation mode to limit the acceleration of the engine in a lateral linear direction and to operate the engine below a torsional vibration limit.

* * * * *